United States Patent [19]

Somers et al.

[11] 3,950,132

[45] Apr. 13, 1976

[54] METHOD FOR DYEING AND CONTINUOUS HEAT SETTING OF TEXTILE YARNS

[75] Inventors: Jack Somers; Elias Cuthbert, both of Dundee, Scotland

[73] Assignee: Caird (Dundee) Limited, Dundee, Scotland

[22] Filed: Jan. 30, 1974

[21] Appl. No.: 437,805

[30] Foreign Application Priority Data

Feb. 3, 1973 United Kingdom ..... 5455/73

[52] U.S. Cl. ..... 8/149; 8/151.2; 28/75 R; 28/77; 68/13 R

[51] Int. Cl.² ..... D06B 23/04

[58] Field of Search ..... 8/149, 150, 151, 151.2; 68/202–205, 207, 5 D, 5 E, 13 R, 19.1, 20, 3 R, 10, 11, 28; 28/77, 75 R

[56] References Cited

UNITED STATES PATENTS

| | | | |
|---|---|---|---|
| 3,491,561 | 1/1970 | Crump | 68/202 |
| 3,650,674 | 3/1972 | Newton | 68/205 R |
| 3,659,439 | 5/1972 | Tindall | 68/5 D |
| 3,696,642 | 10/1972 | Rigacci | 68/205 R |
| 3,728,076 | 4/1973 | Fleissner | 68/5 D |
| 3,819,469 | 6/1974 | Balch | 28/77 |

*Primary Examiner*—Harvey C. Hornsby
*Assistant Examiner*—Philip R. Coe
*Attorney, Agent, or Firm*—Norris & Bateman

[57] ABSTRACT

The method for the random dyeing of yarn in which yarn slivers are laid in a tensionless zig-zag formation onto a travelling stenter pin chain conveyor, applying longitudinal rows of stitching or tape to anchor the yarn slivers in position and to take the tension of feeding the yarn slivers through rollers which apply dye liquor of differing colours or shades in longitudinal stripes and fixing, washing and drying and heat setting the slivers and finally rewinding the individual yarn slivers onto separate yarn packages to produce yarn randomly dyed throughout its length.

5 Claims, 2 Drawing Figures

METHOD FOR DYEING AND CONTINUOUS HEAT SETTING OF TEXTILE YARNS

This invention relates to an improved method for dyeing and continuous heat setting of textile yarns and also more particularly to the random dyeing of the yarns.

It has been proposed to dye yarns in a random manner by first knitting the yarns into a fabric then dyeing the knitted fabric and finally unravelling the knitting and rewinding the yarn onto packages, this process is, however, cumbersome and may detract from the feel of the yarn and the coverage by the dye.

According to the invention the method comprises laying slivers of yarn in zig-zag convolutions transversely on a travelling conveyor and in a tensionless condition, anchoring the yarn convolutions longitudinally of the movement of the conveyor, passing the yarn slivers continuously through rollers which apply dye liquor of differing colours or shades in longitudinal stripes, fixing, washing and drying the slivers, and rewinding the individual slivers to produce yarn randomly dyed throughout its length.

The invention will be described with reference to the accompanying drawings.

Figure 1:
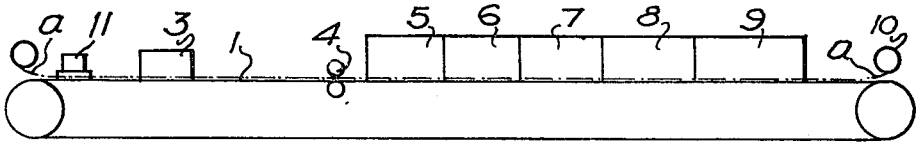
FIG. 1 is a diagrammatic longitudinal section showing apparatus for traversing the yarn.
Figure 2:
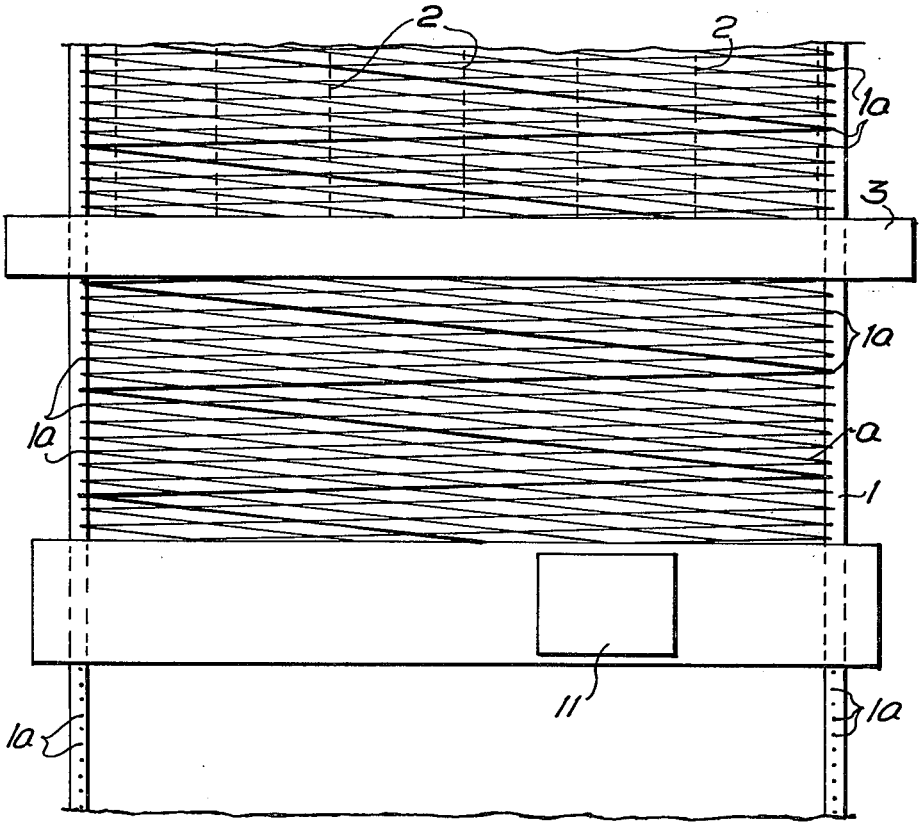
FIG. 2 is a plan view showing diagrammatically the traversing mechanism and the yarn laid out on the conveyor.

Yarn *a* to be dyed in random fashion is applied to a travelling chain conveyor 1 by a traversing mechanism 11 traversing from side to side over the travelling conveyor to lay the yarn in a zig-zag formation thereover with each sliver of yarn passing behind stenter pins 1*a* on the chains of the conveyor at each side thereof. Multiple ends of the yarn *a* are preferably laid simultaneously to overlay each other and are held in position by longitudinal rows of chain stitching 2 extending parallel to the chains and inserted by sewing machines 3.

The yarn is in a tensionless condition and the tension applied for traversing the yarn through colour applying embossed rollers 4 is taken by the stitching 2. Alternatively the yarn may be held in position by an adhesive or other tape or tapes applied parallel to the chains.

After stitching the yarn is fed through the dyestuffs applicator 5 and passes continuously through a fixing zone 6, a washing zone 7 and a drying and heat setting zone 8. The stitching 2 or tape absorbs the traction tension and is then removed from the yarn *a* at zone 9 and the individual ends are rewound onto packages 10.

The yarn may be of nylon or other fibre and is particularly applicable for use in the manufacture of tufted carpets but may be used for many other purposes such as knitting yarns.

The yarn is dyed by dyestuffs applicable to the particular yarn passing through the machine and is applied in known manner in stripes of differing colours or shades. The several zones for fixing, washing and drying and heat setting are all known apparatus for the treatment of yarn.

What we claim is:

1. A method for the production of randomly dyed textile yarn wherein one or more individual slivers of yarn are laid in transversely zig-zag convolutions in tensionless condition along conveyor means and successively passed through random dyeing, fixing, washing and drying and heat setting stations and then the individual yarn sliver or slivers wound upon separate yarn carriers to produce packages of yarn randomly dyed along its length, characterized by the steps of holding said convolutions in relative longitudinal positions after they are laid on said conveyor means and maintaining such during passage through all of said stations, and then releasing said convolutions for winding the sliver or slivers on said carriers.

2. The method defined in claim 1, wherein successive convolutions are anchored directly on said conveying means at least during dyeing.

3. The method defined in claim 1, wherein said convolutions are held in relative longitudinal positions by stitching extending in the direction of conveyor movement.

4. The method defined in claim 1, wherein said convolutions are held in relative longitudinal position by tapes extending in the direction of conveyor movement.

5. The method defined in claim 1, wherein dyeing is effected by rollers that apply the dye in differing coloring and/or shades of coloring in longitudinal stripes.

* * * * *